United States Patent [19]

Jorgensen et al.

[11] Patent Number: 4,625,087

[45] Date of Patent: Nov. 25, 1986

[54] PORTABLE TURNTABLE FOR USE IN MICROWAVE OVENS

[75] Inventors: Jorgen A. Jorgensen, Bloomington; Donald W. Nygren, St. Louis Park; Douglas J. Kluge, Golden Valley; Jerel P. Traun, Coon Rapids, all of Minn.

[73] Assignee: Northland Aluminum Products, Inc., Minneapolis, Minn.

[21] Appl. No.: 803,156

[22] Filed: Dec. 2, 1985

[51] Int. Cl.[4] ..... H05B 6/80; A47B 11/00

[52] U.S. Cl. ..... 219/10.55 F; 219/10.55 E; 108/20; 108/141; 108/142; 99/443 R

[58] Field of Search ..... 219/10.55 F, 10.55 E; 108/20, 139, 141, 142, 146, 148; 126/338 R; 99/443 R, 451, DIG. 14

[56] References Cited

U.S. PATENT DOCUMENTS 3,300,615 1/1967 Smith ..... 219/10.55 F
3,880,096 4/1975 Kaplan ..... 108/142 X
4,258,630 3/1981 Jorgensen et al. ..... 108/20
4,434,343 2/1984 Bowen et al. ..... 219/10.55 F
4,523,070 6/1985 Jorgensen et al. ..... 219/10.55 F

*Primary Examiner*—Philip H. Leung
*Attorney, Agent, or Firm*—Orrin M. Haugen; Thomas J. Nikolai

[57] ABSTRACT

Locking mechanism for a mechanically driven, low profile, portable turntable for use in cooking ovens, especially microwave ovens, for rotating foodstuffs while cooking. The low profile turntable includes a spring which varies the height of the rotating portion of the turntable with respect to the base between a first predetermined position when there is no food or the like on the turntable and a second predetermined position when there is food on the turntable. The locking mechanism includes notches and prongs located on the rotating portion and base portion of the turntable which engage each other when the turntable is in the first predetermined position to prevent rotation of the turntable.

11 Claims, 3 Drawing Figures

PORTABLE TURNTABLE FOR USE IN MICROWAVE OVENS

BACKGROUND OF THE INVENTION

I. Field of the Invention

This invention relates generally to a cooking appliance and more specifically to a food rotator for use in an oven. The food rotator turns the item being prepared so that it will be uniformly exposed to infrared or microwave energy during cooking.

II. Discussion of the Prior Art

Turntables for use in an oven environment to provide more uniform cooking is an old concept. The Shaw U.S. Pat. No. 557,344 describes a turntable device having a spring motor for rotating the table and it dates back to the late 1800's. At that time, most ovens were wood or coal-fired and, as such, the heat was not evenly distributed within the oven chamber. By rotating the food while cooking, it would be more uniformly exposed to the infrared energy.

With the advent of natural gas and electric ranges, it became possible to design a burner arrangement such that the heat was uniformly distributed within the oven chamber. Hence, the need for turntables such as that shown in Shaw was obviated. However, in the late 1940's or early 1950's when microwave ovens came into vogue, it was discovered that microwaves are not uniformly distributed within the oven enclosure and, as a result, so-called "hot spots" developed whereby the cooking was not uniform throughout the article being heated. Thus, the turntable approach again came into popularity.

During the 1970's, built-in turntables were primarily found in microwave ovens of Japanese manufacture. U.S. Pat. No. 4,036,151 to Shin describes such a built-in turntable structure. U.S. manufacturers, on the other hand, attempted to solve the "hot spot" problem by finding ways to more evenly distribute microwaves throughout the oven cavity. So-called "mode stirring" devices were built into ovens. This approach has not been altogether satisfactory and many thousands of microwave ovens have been sold and are in use which do not adequately distribute the microwave energy through the oven cavity and which do not include a built-in turntable.

Various portable food rotator devices have been devised for use in microwave ovens. The Beh et al U.S. Pat. No. 4,254,319 describes a portable turntable device driven by a spring-type motor wherein all the parts comprising the motor and escapement are fabricated from a plastic that tends not to heat up when exposed to microwave energy. The device shown in the Beh et al Patent, however, has never been used on a large commercial scale primarily because of the inability of a plastic spring to store sufficient energy for rotating the turntable over a prolonged period.

The Cunningham U.S. Pat. No. 4,239,009 is another example of a prior are portable turntable design. Incorporated in this design were a standard spring motor and escapement constructed using metal parts. This design proved to be commercially impractical because when it was exposed to microwave energy, the metallic parts produced considerable arcing, sparking and over-heating.

A solution was provided to the drawbacks attendant in the device of the Cunningham Patent by our earlier invention which is described in U.S. Pat. No. 4,258,630 to Jorgensen et al. In this earlier design, the spring motor and escapement are disposed beneath a rotatable turntable and are contained within a smooth metallic shield having no sharp edges to serve as high potential discharge points. Having solved this problem, applicants' assignee, Northland Aluminum Products, Inc., has been highly successful in selling its MICRO-GO-ROUND® turntable for use in microwave ovens which do not have a built-in food rotator.

Microwave ovens for home use have a relatively small oven compartment and, as such, it is desirable that the turntable present a low profile so as not to take up room which could otherwise be used to contain the food items to be cooked. The Pomeroy et al Pat. No. 4,330,696 attempts to address this problem by relocating the drive motor assembly so that it does not fit beneath the rotatable table itself. Instead, the motor assembly is housed separately from the turntable structure and is positioned alongside the turntable rather than beneath it. The drive assembly is coupled through a suitable spur gear to cooperate with the gear teeth formed in the rim of the turntable element. The theory underlying the design described in the Pomeroy Patent is that the motor assembly is positioned in the corner of the microwave oven and, accordingly, is supposedly less obtrusive both in terms of occupying space otherwise available for food and in terms of being located in the zone of low density microwave energy. In practice, however, the positioning of the drive unit alongside the turntable interferes with the free rotation of certain food items when placed on the turntable beyond that which is dictated by the corners of the oven.

In attempting to address and solve the problems inherent in the prior art designs, we have previously developed a low height profile design wherein the motor, escapement and shielding are contained within a cavity between the base of the portable unit and the turntable itself. This design is shown in U.S. patent application Ser. No. 505,370 now U.S. Pat. No. 4,523,070. This design achieved the goal of providing a turntable having a low profile but with a drive assembly for the turntable being disposed beneath the rotatable table portion of the device. In this way, large casseroles, roasts and fowl will still fit within the oven space and will rotate freely without interference from any upward projecting drive elements of the turntable.

Several of the prior art designs include manual switch mechanisms which are used to permit or restrict the rotation of the turntable. Such switching mechanisms, however, are relatively inconvenient since they are not automatically actuated by placing or removing items to be cooked from the turntable. Instead, they must be manually and independently actuated. It can be seen, then, that it is desirous to provide a turntable having a low height profile and a drive assembly which will permit maximum use of the available space within the oven for cooking food and which includes a switching mechanism that automatically prevents the turntable from rotating when no item is upon it and permits the turntable to rotate when there is.

SUMMARY OF THE INVENTION

The turntable design of the present invention affords these desired advantages and characteristics through a unique mechanical design arrangement. A metal spring motor is utilized to provide long periods of operation, but that spring motor is contained within a microwave reflective (metal) case. Formed centrally through the top of this case is a circular opening of a predetermined diameter which is centered over the main drive gear. The turntable on which the food item rests, then, is situated upon and driven by rotation of the main drive gear as the energy is released from the steel spring of the motor.

Also incorporated within the design is a unique locking or switching mechanism. The switching or locking mechanism includes a spring which may either surround or be contained within the drive shaft extending between the turntable and the main drive gear. When food is placed upon the turntable, the weight causes the spring to be compressed. When the food is removed from the turntable this spring expands. The switching or locking mechanism also includes one or more prongs along a downwardly projecting rim of the turntable and extending inwardly from this rim. Finally, the locking or switching mechanism includes a series of notches uniformly spaced along the underside of an outwardly projecting ledge on the base. The prongs and notches are dimensioned so that they will engage each other when the turntable is forced in an upward direction with respect to the base by expansion of the spring.

When no food items are present on the turntable, the spring causes the turntable to be slightly elevated to a point where the prongs engage the notches preventing rotation of the turntable. The placement of food upon the turntable causes the spring to be compressed, the turntable to lower and the prongs and grooves to become disengaged from each other allowing free rotation of the table.

It is accordingly a principal object of the present invention to provide an improved turntable for rotating foods within an oven.

Another object of the invention is to provide a food rotator for a microwave oven exhibiting a low height profile.

Still another object of the invention is to provide a portable turntable for use in a microwave oven which will automatically permit rotation of the turntable when in use and restrict rotation of the turntable when not in use.

These and other objects and advantages of the invention will become apparent to those skilled in the art from the following detailed description of the preferred embodiment when considered in conjunction with the accompanying drawings in which like numerals in the several views refer to corresponding parts.

DESCRIPTION OF THE PREFERRED EMBODIMENT

Figure 1:
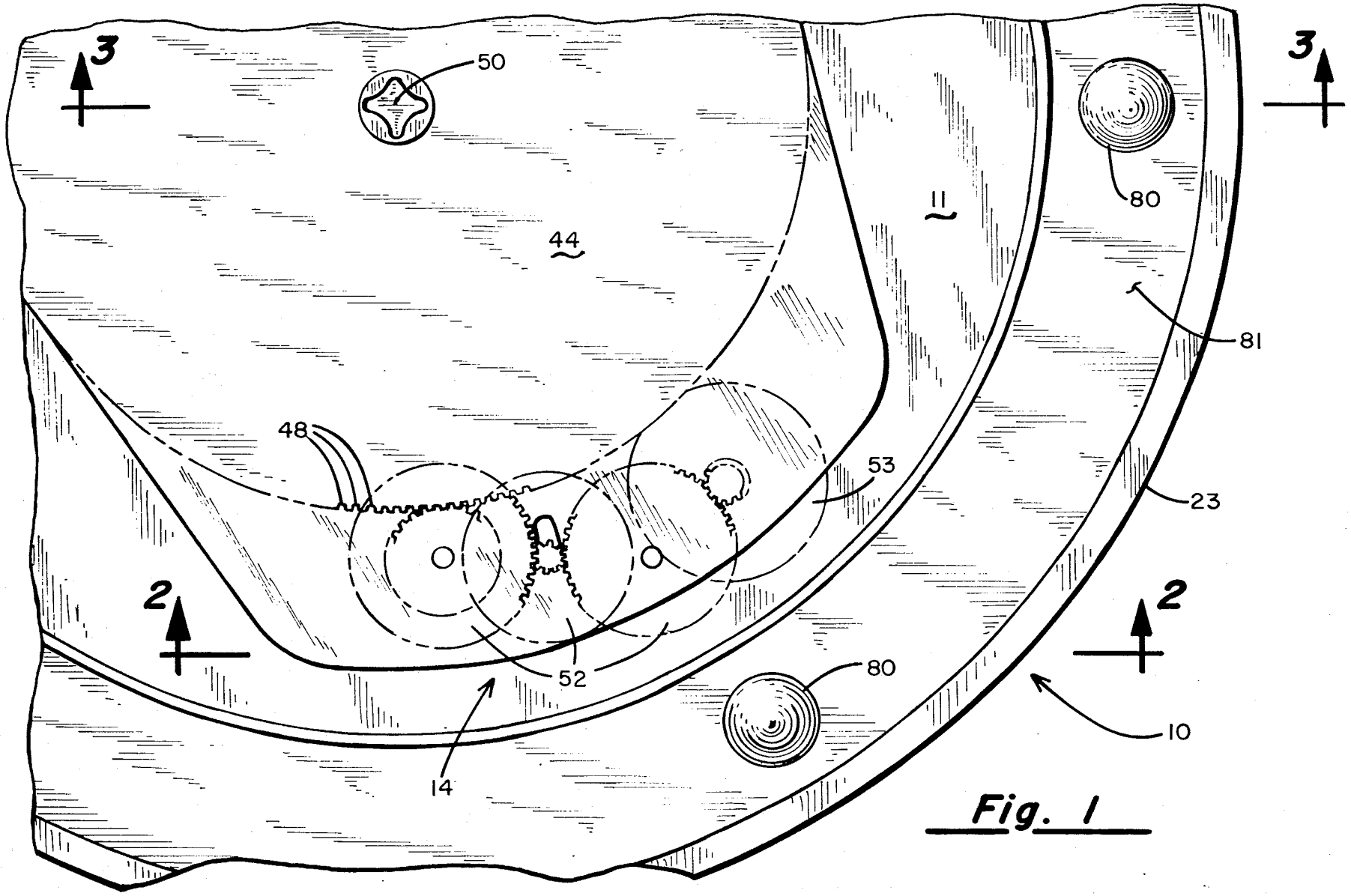
FIG. 1 is a partially broken away plan view of a preferred embodiment with the turntable and top shielding removed to show the internal construction.

Certain terminology will be used in the following description for convenience and reference only and should not be considered as limiting. The words "upwardly", "downwardly", "rightwardly", and "leftwardly" will refer to directions in the drawings to which the reference is made. The words "inwardly" and "outwardly" will refer to the directions toward and away from respectively, the geometric center of the device and associated parts thereof. Said terminology will include the words above specifically mentioned, derivatives thereof and words of similar import.

Figure 2:
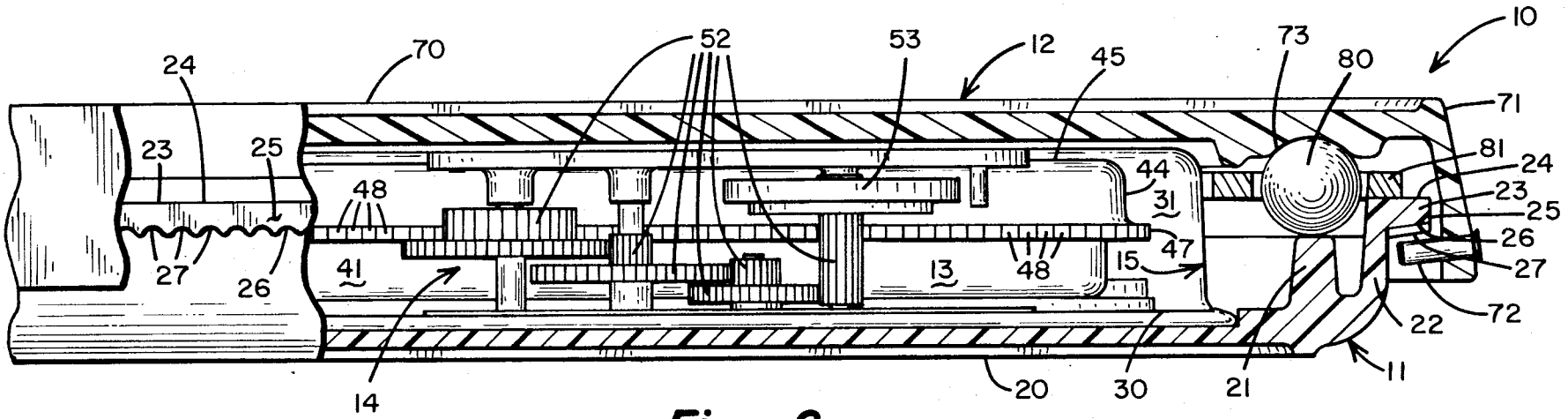
FIG. 2 is a cross-sectional view through line 2—2 of FIG. 1.
Figure 3:
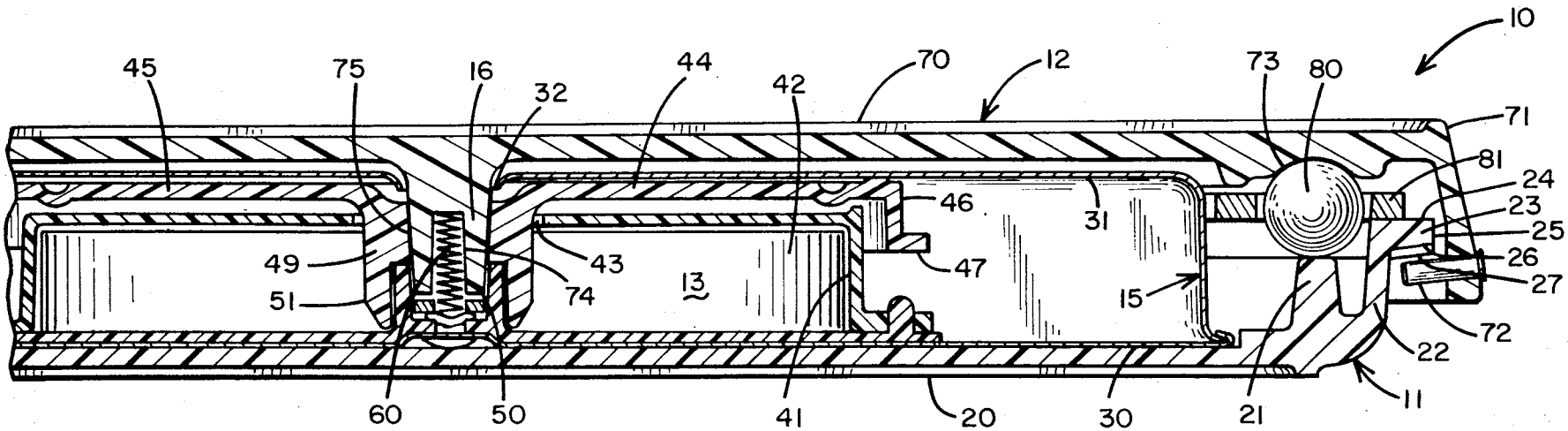
FIG. 3 is a cross-sectional side view through line 3—3 of FIG. 1.

Turning now to FIGS. 1–3, shown generally at 10 is a portable turntable of the preferred embodiment. Portable turntable 10 can generally be described as including a base portion 11, a turntable portion 12, a spring motor 13, a braking system 14, shielding 15 and a drive shaft 16.

Base 11 has an essentially flat, round bottom 20. Extending upwardly from the bottom 20 near its periphery are a circular inner wall 21 and a circular outer wall 22. The outer wall 22 is slightly taller than and slightly spaced from inner wall 21. The differences in height and the distance between the inner and outer walls form a raceway upon which a plurality of ball bearings 80 can be placed. Ring 81 is placed over the ball bearings so that they remain uniformly spaced around the raceway.

Extending outwardly from outer wall 22 is a ledge 23. Ledge 23 has a flat top surface 24 and a flat side surface 25. In the preferred embodiment, the lower surface 26 of ledge 23 is serrated with uniformly spaced notches 27. The purpose of these notches 27 will be discussed in greater detail below.

Mounted on the upper surface of bottom 20 of base 11 is the spring motor 13, the braking system 14, and the shielding 15. The shielding 15 is made of a smooth microwave reflective material (metal) which has no edges or the like which could cause arcing when used in a microwave oven environment. Its purpose is to surround the spring motor 13 and braking system 14 to protect them from the damaging effects that microwave energy can have upon them. The shielding 15 is comprised of a base portion 30 and a cover 31, the two being crimped together about their periphery. The motor 13 and braking system 14 are fixedly secured to the base portion 30 of the shielding 15. The center of the cover 31 has an opening 32 sufficiently large to receive the drive shaft 16 which runs between the motor 13 and the turntable portion 12. Opening 32 is also smaller than the wavelength of the microwaves used in cooking so that there is little likelihood that microwaves could pass through opening 32 and cause arcing or damage to the drive motor 13 and braking system 14.

The spring motor 13 is comprised of a plastic two-part housing 41 and a metal coil power spring 42. The two-part housing 41 has a cylindrical shape and an opening 43 through the center of its top. Housing 41 surrounds metal spring 42. The spring 42 is fixedly attached at its outside end to the housing 41. Also associated with the motor 13 is a main gear 44. The gear 44 has a round, generally flat top surface 45, a downwardly projecting sidewall 46, and an outwardly projecting lip 47 which has a plurality of spaced teeth 48. Gear 44 also has a downwardly projecting shaft 49. Shaft 49 has a uniquely configured hollow bore 50 through its center which is intended to receive the drive shaft 16. Shaft 49 also has teeth projecting from its outer wall 51. The inside diameter of the gear 44 is greater than the outside diameter of housing 41. Further, the outside diameter of shaft 47 is less than the diameter of opening 43 located in the center of the two-part housing 41 so that when assembled, the gear 44 fits over the housing 41 and the shaft 49 of the gear 44 is received within the opening 43 of housing 41.

The braking system 14 is comprised of a series of interlocking gears 52 of an appropriate ratio which drive a unique flywheel governor 53. The braking system 14 is positioned so one of its sets of gears will mesh with the teeth 48 located on the main gear 44. The braking system 14 is present to control the speed at which the energy stored in spring 42 of the motor 13 discharges. It thus controls the rate at which main gear 44 rotates.

Secured to the bottom portion of the motor housing 41 at its center of the motor is a compression spring 60. Spring 60, when unloaded, projects upwardly through opening 43 located at the center of housing 41, hollow bore 50 of the main gear 44, and center opening 32 of the shielding 15.

The turntable portion 12 upon which the food items rest is best characterized as having a flat round top 70, a downwardly projecting side wall 71, a plurality of pins or prongs 72 projecting inwardly from the side wall 71, an integrally molded raceway 73 located on the inward surface of the top 70 for receiving the ball bearings 80, and a downwardly projecting center drive shaft 16. The turntable portion 12 has a diameter slightly greater than that of base portion 11. The center drive shaft 16 has a hollow bore 74 for receiving spring 60. Drive shaft 16 also has an outer wall 75 of an appropriate size and shape so that it can be received by bore 50 of the main gear 44 and driven by the motor 13.

When assembled and in use, the portable turntable's spring motor 13 is wound by rotating the turntable 12 with respect to the base 11 and the parts fixedly attached thereto in a direction opposite to its normal direction of rotation when it is being driven by the spring motor. When nothing has been placed on the turntable, spring 60 forces the turntable 12 upward, away from the base 11 until prongs 72 on the turntable 12 mesh with the notches 27 on the base 11. When the prongs 72 and the notches 27 engage each other, they function as a lock or stop and prevent rotation of the turntable 12 relative to the base 11 despite the wound state of the spring motor 13. If a food object is placed upon the turntable 12, the extra weight causes compression of spring 60 and the turntable portion 12 thus moves in a downward direction. As the turntable 12 moves downward, notches 27 and prongs 72 become disengaged from each other to permit free rotation of the turntable 12 relative to the base 11 by the spring motor 13. Of course, when the food item is removed following the cooking thereof, the turntable 12 again rises to the point where the pins 72 will mate with the notches 27 to stop the rotation of the turntable.

The invention has been described herein in considerable detail in order to comply with the Patent Statutes and to provide those skilled in the art with the information needed to apply the novel principles, and to construct and use such specialized components as are required. However, it is to be understood that the invention can be carried out by specifically different equipment and devices, and that various modifications, both as to equipment details and operating procedures, can be accomplished without departing from the scope of the invention itself.

We claim:

1. A portable turntable for use in an oven comprising:

(a) a generally cylindrical base having a planar bottom, a cylindrical side wall projecting upwardly therefrom, and a ledge projecting outwardly from said cylindrical side wall, said ledge including at least one notch therein;

(b) a spring case secured to said planar bottom of said housing member, said spring case having a central opening of a predetermined diameter;

(c) a first gear member having gear teeth on the peripheral edge thereof and a central shaft having an opening therethrough projecting from a first major surface thereof, said shaft being journaled for rotation within said central opening in said spring case;

(d) a spiral power spring disposed in said spring case;

(e) means securing one end of said power spring to said spring case and means connecting the other end of said power spring to said central shaft;

(f) means for regulating the speed of rotation of said first gear member, said means cooperating with said gear teeth on said first gear member;

(g) a generally cylindrical turntable member having a generally planar top and bottom, an annular side wall projecting downwardly therefrom, at least one prong projecting inwardly from said cylindrical side wall, a central shaft projecting downwardly from said bottom of said turntable member, said shaft being journalled for rotation within the opening of the central shaft of the first gear member; and (h) biasing means disposed between said spring case and said shafts for resiliently urging said turntable member away from said base to allow engagement of said prong with said notch.

2. The turntable of claim 1 wherein said biasing means is a compression spring secured at one of its ends to the bottom of the spring case with its other end abutting said shaft of said turntable member.

3. The turntable of claim 2 wherein said compression spring projects upwardly into said opening formed in said shaft of said first gear member.

4. The turntable of claim 1 wherein said spring case is at least partially surrounded by said first gear member.

5. The turntable of claim 1 wherein said means for regulating the speed of rotation of said first gear member includes:

(a) a gear train comprising a plurality of overlapping gear elements journaled for rotation about vertical axes, one of said gear elements cooperating with said gear teeth on said first gear member, and (b) a flywheel member secured to a shaft journaled for rotation about a vertical axis between said planar bottom and said annular cover of said housing, said shaft being drivingly coupled to said gear train.

6. The portable turntable of claim 1 further including shielding means made of a microwave reflective material surrounding said spring case.

7. A portable turntable for use in a microwave oven including:

(a) base means including a planar bottom, a continuous, annular side wall projecting upwardly from said planar bottom;

(b) a motor fixedly coupled to said base means;

(c) turntable means including a planar top and a continuous side wall projecting downwardly from said top;

(d) rotary drive means interconnecting said motor and said turntable means;

(e) spring means for changing the relative height of the turntable means with respect to the base means between a first predetermined height and a second predetermined height; and (f) locking means which prevent rotation of the turntable means with respect to the base means when the turntable means is at a first predetermined height and permits rotation of the turntable means with respect to the base means when the turntable means is at a second predetermined height.

8. The portable turntable of claim 7 wherein said locking means include:

(a) a ledge projecting outwardly from the continuous side wall of the base means, said ledge having at least one notch; and (b) at least one prong projecting inwardly from said side wall of said turntable means, said prongs being dimensioned and positioned so that they will be received within said notches when the turntable means is at a first predetermined height.

9. The portable turntable of claim 7 wherein said locking means include:

(a) a prong projecting outwardly from the continuous side wall of the base means; and (b) a notch associated with the continuous side wall of the turntable means, said notch being dimensioned and positioned so that it will receive said prongs when the turntable means are at said first predetermined height.

10. A portable turntable for use in an oven comprising:

(a) a base member having a planar bottom and an annular sidewall projecting upward from said base, said annular side wall including an outwardly projecting rim, said rim including at least one notch therein;

(b) a motor assembly mounted on said base;

(c) a turntable member journaled for rotation in a plane parallel to said planar bottom of said base member, said turntable member being generally cylindrical and including a downwardly extending annular sidewall of a size to partially surround said annular sidewall of said base member, and a drive shaft operatively coupled to said motor assembly, said turntable member being vertically movable between an elevated position and a lowered position;

(d) at least one prong projecting through said annular side wall of said turntable member and engaging said notch when said turntable is in its elevated position to prevent rotation of said turntable member relative to said base member, but disengaged from said notch when said turntable member is in its lowered position; and (e) biasing means for resiliently urging said turntable member to its upper disposition.

11. The portable turntable as in claim 10 wherein said biasing means comprises a compression spring disposed between said planar bottom of said base member and said drive shaft of said turntable member.

* * * * *